US006474955B1

(12) United States Patent
Ota et al.

(10) Patent No.: US 6,474,955 B1
(45) Date of Patent: Nov. 5, 2002

(54) HINGE MECHANISM FOR VARIABLE DISPLACEMENT COMPRESSORS

(75) Inventors: Masaki Ota; Tomoji Tarutani; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/568,363

(22) Filed: May 10, 2000

(30) Foreign Application Priority Data

May 13, 1999 (JP) ..... 11-132646

(51) Int. Cl.[7] ..... F04B 1/26

(52) U.S. Cl. ..... 417/222.2; 417/269; 92/71; 91/505

(58) Field of Search ..... 417/222.2, 269; 92/71; 91/505

(56) References Cited

U.S. PATENT DOCUMENTS 5,231,914 A 8/1993 Hayase et al. ..... 92/12.2
5,540,559 A 7/1996 Kimura et al. ..... 417/222.2
5,699,716 A * 12/1997 Ota et al. ..... 92/12.2
5,857,402 A * 1/1999 Hoshida et al. ..... 92/12.2
5,915,928 A * 6/1999 Murase et al. ..... 417/269
5,941,161 A * 8/1999 Kimura et al. ..... 92/155
5,953,980 A * 9/1999 Ota et al. ..... 92/71
5,984,643 A * 11/1999 Ota et al. ..... 417/269
6,076,449 A * 6/2000 Kawaguchi et al. ..... 92/12.2
6,112,639 A * 9/2000 Kimura et al. ..... 92/12.2
6,152,845 A * 11/2000 Okada et al. ..... 474/93
6,158,970 A * 12/2000 Ota et al. ..... 417/222.2
6,164,926 A * 12/2000 Kawaguchi ..... 417/222.2
6,164,929 A * 12/2000 Kazuya et al. ..... 417/362

FOREIGN PATENT DOCUMENTS

EP 0 755 824 A1 5/1997
EP 0 867 617 A2 9/1998
JP 6-288347 10/1994
JP 10-054353 2/1998
JP 2001-289159 A 10/2001

* cited by examiner

*Primary Examiner*—Cheryl J. Tyler
*Assistant Examiner*—W Rodriguez
(74) *Attorney, Agent, or Firm*—Morgan & Finnegan, LLP

(57) ABSTRACT variable displacement compressor has a drive shaft extending through a crank chamber. A lug plate is integrally fixed to the drive shaft. A drive plate is connected to and driven by the lug plate by a hinge mechanism. The drive plate inclines with respect to the drive shaft to vary the displacement of the compressor. The hinge mechanism has a linear guide on the lug plate and a pin projecting from the drive plate toward the lug plate. A bearing surface engages the pin. The pin has an axis that intersects an axis of the guide. The axis of the pin is parallel to the axis of the drive shaft when the compressor operates with a maximum load.

20 Claims, 3 Drawing Sheets

HINGE MECHANISM FOR VARIABLE DISPLACEMENT COMPRESSORS

BACKGROUND OF THE INVENTION

The present invention relates to a hinge mechanism for variable displacement compressors used in, for example, automobile air-conditioners.

A typical variable displacement compressor has a housing, which houses a crank chamber, and a cylinder block. A drive shaft extends through the crank chamber. Cylinder bores extending through the cylinder block accommodate pistons. A lug plate is fixed to the drive shaft to rotate integrally with the drive shaft. A swash plate, which drives the pistons, is located adjacent to the lug plate.

The lug plate is connected to the swash plate by a hinge mechanism. Each piston is coupled to the swash plate. In this structure, the difference between the pressure of the crank chamber and the pressure of the cylinder bores is altered by adjusting the size of the opening in a displacement control valve. The inclination of the swash plate changes in accordance with the pressure difference, the displacement of the compressor varies accordingly.

With reference to FIG. 4, a hinge mechanism 51, which enables a swash plate 54 to incline, includes a guide bore 53 formed on a rear surface 52*a* of a lug plate 52 and a pin 55 projecting from a front surface of the swash plate 54. The guide bore 53 is formed so that its axis AXg is inclined relative to the rear surface of the lug plate 52. The pin 55 has a spherical end portion 55*a,* which is received by the guide bore 53 and which slides along the guide bore 53 in the direction of the guide bore axis AXg.

When the compressor is operated, a compression load acts on the pin 55. This applies a bending moment M to a proximal end 55*b* of the pin 55. The bending moment M is calculated from equation (1).

$$M=Fa\cdot L=Fb\cdot\cos\theta\cdot L \quad (1)$$

In the equation, Fa represents the force applied to the spherical portion 55*a* of the pin 55 by the compression load in a direction perpendicular to the pin axis AXp. Fb represents the force applied to the spherical portion 55*a* by the compression load in a direction perpendicular to the guide bore axis AXg. The symbol L represents the length of the pin 55 extending from the swash plate 54, and θ represents the angle between the pin axis AXp and the guide bore axis AXg. The angle θ is equivalent to the angle formed between the two forces Fa, Fb.

The length L of the pin 55 must be relatively long so that the pin 55 can move in the guide bore 53 for a distance that enables the swash plate 54 to move between a maximum inclination position and a minimum inclination position. Further, the angle θ between the pin axis AXp and the guide bore axis AXg must be minimized to avoid interference between the guide bore 53 and the pin 55. This results in a large force Fa being applied to the spherical portion 55*a* of the pin 55 by the compression load.

In the structure of FIG. 4, the bending moment M applied to the proximal end 55*b* of the pin 55 is large. Therefore, the pin 55 must be securely fixed to the swash plate 54 by press-fitting the proximal end 55*b* of the pin 55 into a retaining bore 54*a* of the swash plate 54. Therefore, the dimensions of the proximal end 55*b* and the retaining bore 54*a* must be accurate. Further, the diameter and length of the press-fitted portion including the proximal end 55*b* must be as large as possible. This enlarges the pin 55 and its surrounding components. As a result, the manufacturing cost increases, and the weight of the compressor increases.

Japanese Unexamined Patent Publication No. 10-54353 proposes a compressor in which the pin is located on the lug plate and received by a guide groove in the swash plate. The guide groove extends diagonally relative to the front surface of the swash plate. The pin slides in the axial direction of the guide groove, and the axes of the pin and guide groove intersect.

However, the guide groove must be long to enable the pin to slide between locations corresponding to the swash plate's maximum inclination position (where the displacement of the compressor is maximal) and minimum inclination position (where the displacement of the compressor is minimal). Thus, a large support must be provided on the front surface of the swash plate to form the guide groove. This increases the weight of the swash plate. In addition, the large support may cause a weight imbalance of the swash plate. This would result in inaccurate positioning, or inclination, of the swash plate when the displacement control valve alters the pressure difference between the crank chamber and the cylinder bores.

Furthermore, the pin extends from the rear surface of the lug plate toward a location on the swash plate corresponding to the top dead center position of the pistons. The angle of the pin relative to the drive shaft is always the same regardless of the compressor displacement. Thus, the bending moment at the proximal end of the pin increases as the compressor displacement increases.

SUMMARY OF THE INVENTION

It is an object of the present invention to provide a light and inexpensive variable displacement compressor that ensures satisfactory response to displacement control and simplifies the structure for fixing the pin to a drive plate. To achieve the above object, the present invention provides a variable displacement compressor having a crank chamber and a cylinder bore within a housing, a drive shaft extending through the crank chamber, a lug plate integrally attached to the drive shaft, and a drive plate located adjacent to the lug plate. The drive plate is coupled to the lug plate by a hinge mechanism. The hinge mechanism drives the drive plate and permits the drive plate to rotate with and incline with respect to the drive shaft. The displacement of the compressor varies according to the inclination of the drive plate based on a pressure difference between the crank chamber and the cylinder bore. A guide is provided on the lug plate. The guide has an axis. A pin projects from the drive plate toward the lug plate. The pin engages and is guided by the guide. The pin has an axis. The axis of the guide extends in a direction intersecting the axis of the pin Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENT

Figure 2:
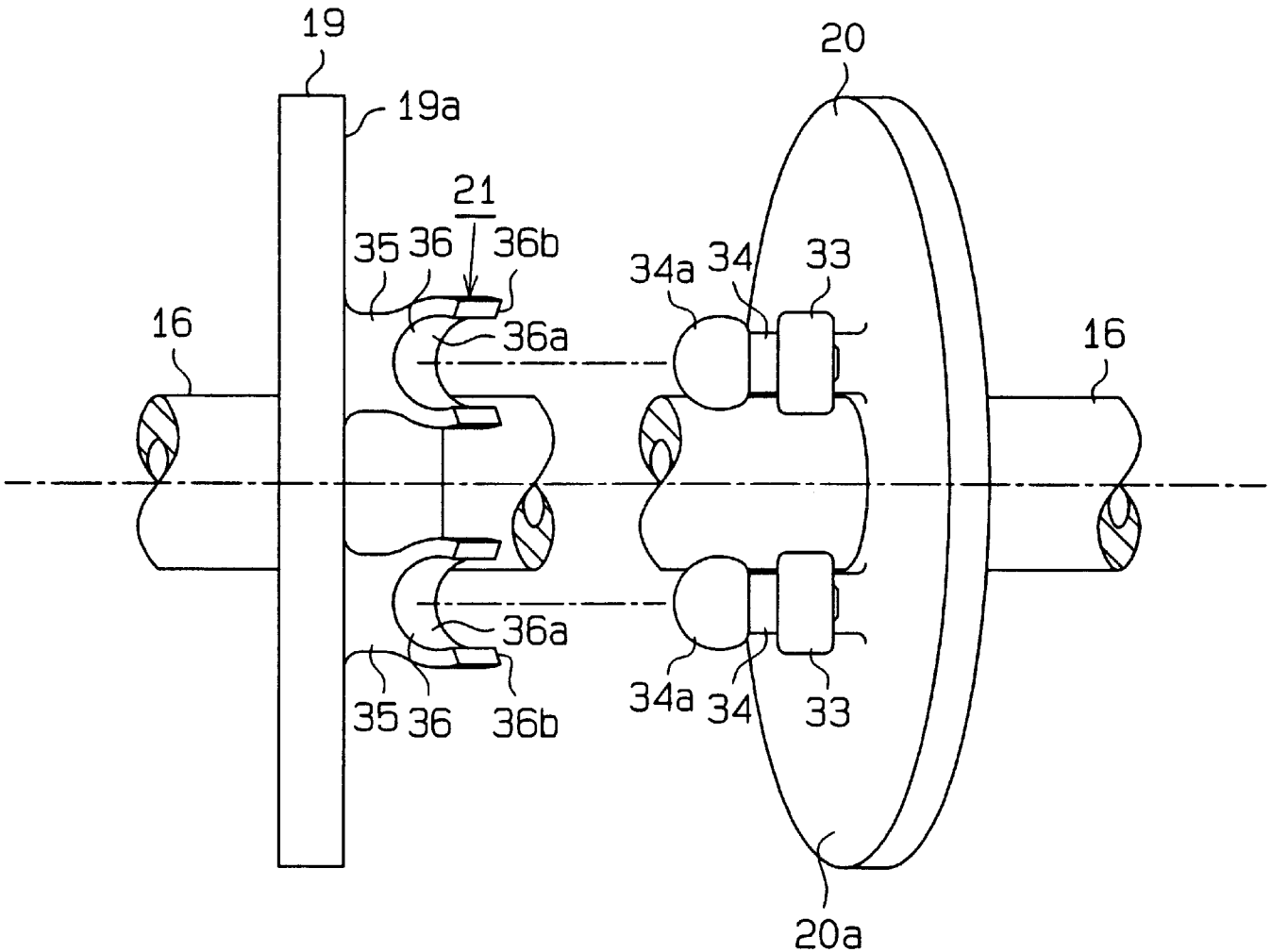
FIG. 2 is an exploded partial plan view showing the hinge mechanism of the compressor of FIG. 1.
Figure 3:
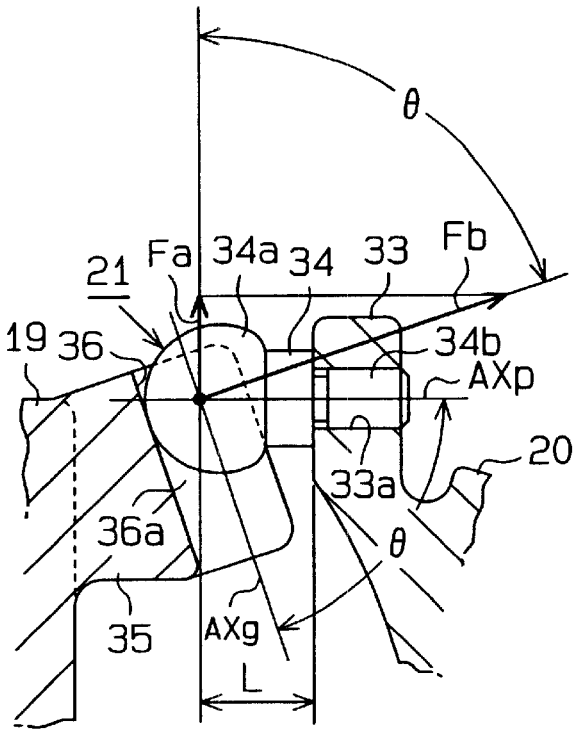
FIG. 3 is an enlarged partial cross-sectional view showing the hinge mechanism of FIG. 2.
Figure 4:
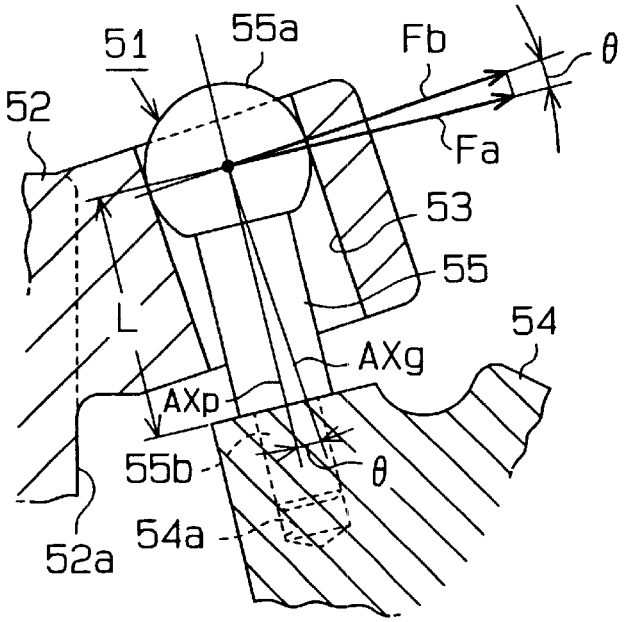
Fig.4(Prior Art)
FIG. 4 is a partial cross-sectional view showing a hinge mechanism of a prior art variable displacement compressor.

A variable displacement compressor according to the present invention will now be described with reference to FIGS. 1 to 3.

Figure 1:
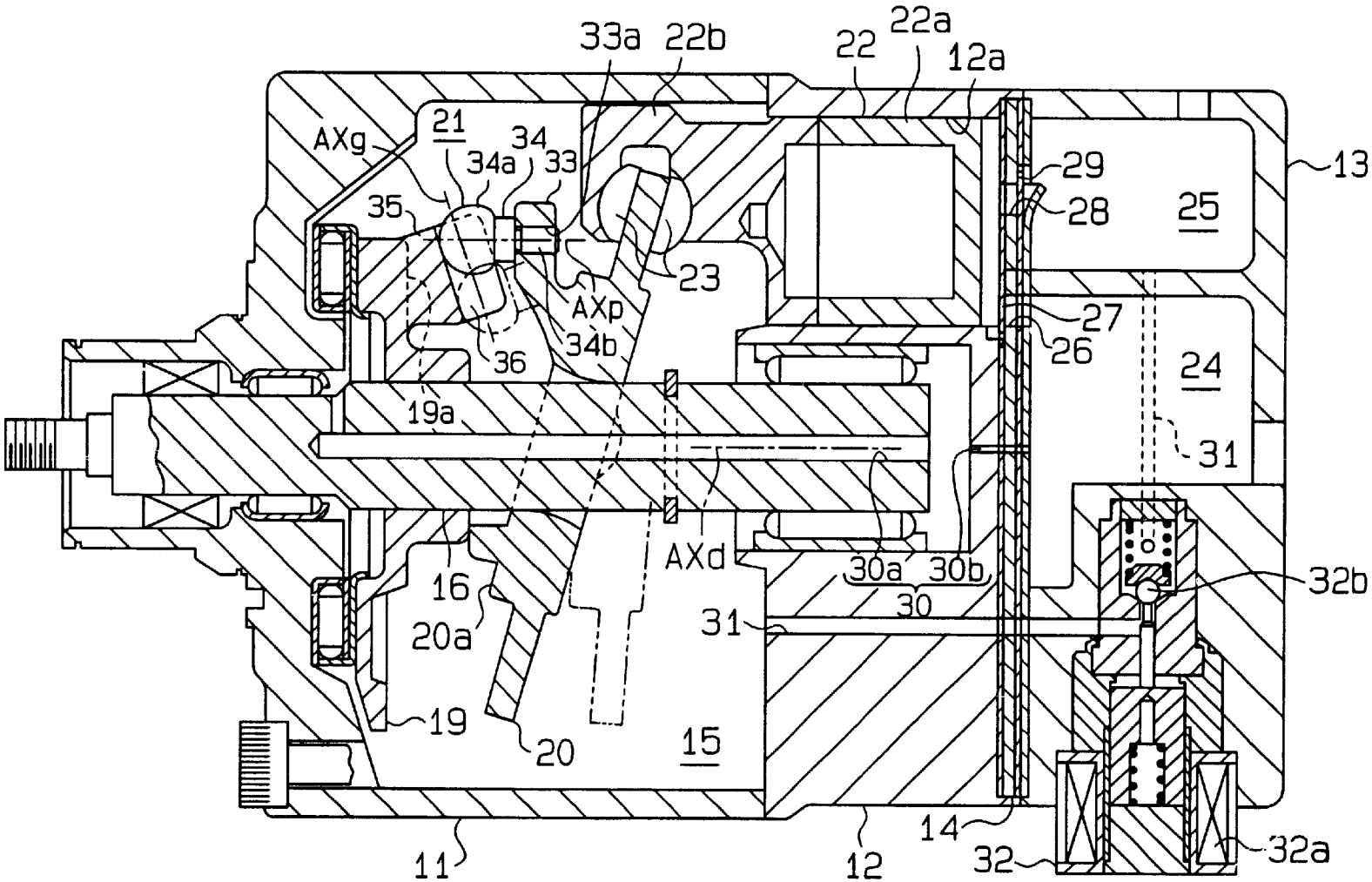
FIG. 1 is a cross-sectional view showing a variable displacement compressor according to the present invention.

As shown in FIG. 1, a front housing 11 is fastened to the front end of a cylinder block 12. A rear housing 13 is fastened to the rear end of the cylinder block 12. A valve plate 14 is arranged between the cylinder block 12 and the rear housing 13. A crank chamber 15 is defined in the front housing 11 and the cylinder block 12.

A rotatable drive shaft 16 extends through the crank chamber 15 between the front housing 11 and the cylinder block 12. The drive shaft 16 is connected to an automobile engine (not shown) or other power source by an electromagnetic clutch. When the engine is running, the clutch connects the drive shaft 16 to the engine and rotates the drive shaft 16.

A lug plate 19 is fixed to the drive shaft 16 in the crank chamber 15 to rotate integrally with the drive shaft 16. A drive plate, which is a swash plate 20 in this embodiment, is fitted to the drive shaft 16 and supported so that it inclines while sliding in the direction of the drive shaft axis AXd.

A hinge mechanism 21 is arranged between the lug plate 19 and the swash plate 20. The hinge mechanism 21 enables the swash plate 20 to rotate integrally with the drive shaft 16 and incline relative to the drive shaft 16. The inclination of the swash plate 20 with respect to a plane perpendicular to the drive shaft 16 decreases when the central portion of the swash plate 20 moves toward the cylinder block 12 and increases when the central portion moves toward the lug plate 19.

Cylinder bores 12*a* extend through the cylinder block 12. A single-headed piston 22 is held in each cylinder bore 12*a*. The head 22*a* of each piston 22 is moved within the cylinder bore 12*a*, and a skirt 22*b* of each piston 22 is coupled to the peripheral portion of the swash plate 20 by shoes 23. The rotation of the swash plate 20 is converted into the reciprocation of the pistons 22 in the cylinder bores 12*a*.

A suction chamber 24 and a discharge chamber 25 are defined in the rear housing 13. The valve plate 14 has a suction port 26, a suction valve 27 (flap valve), a discharge port 28, and a discharge valve 29 (flap valve) for each cylinder bore 12*a*. When the piston 22 moves from its top dead center position to its bottom dead center position, refrigerant gas is drawn into the associated cylinder bore 12*a* through the corresponding suction port 26 and suction valve 27. As the piston 22 moves from the bottom dead center position to the top dead center position, the refrigerant gas is compressed to a predetermined pressure and discharged into the discharge chamber 25 through the corresponding discharge port 28 and discharge valve 29.

The crank chamber 15 and the suction chamber 24 are connected by a bleeding passage 30. The bleeding passage 30 is formed by an axial passage 30*a* extending along the axis of the drive shaft 16 and a communication aperture 30*b* extending through the cylinder block 12 and the valve plate 14. The discharge chamber 25 and the crank chamber 15 are connected by a pressurizing passage 31. The pressurizing passage 31 extends through the rear housing 13, the valve plate 14, and the cylinder block 12.

A displacement control valve 32 is arranged in the pressurizing passage 31. The control valve 32 has a solenoid 32*a* and a valve body 32*b*, which is driven by the solenoid 32*a* to open and close the pressurizing passage 31. The solenoid 32*a* is excited and de-excited by a computer (not shown) in accordance with the cooling load, which depends primarily on the temperature of the passenger compartment. The valve body 32*b* adjusts the opening size of the pressurizing passage 31 to change the pressure of the crank chamber 15. This adjusts the difference between the pressure of the crank chamber 15, which acts on the front of the pistons 22, and the pressure of the cylinder bores 12*a*, which acts on the rear of the pistons 22. The pressure difference adjustment changes the inclination of the swash plate 20, which in turn, alters the stroke of the pistons 22 and varies the displacement of the compressor.

When the solenoid 32*a* is de-excited, the valve body 32*b* opens the pressurizing passage 31 and connects the discharge chamber 25 to the crank chamber 15. This permits the high-pressure refrigerant gas in the discharge chamber 25 to flow into the crank chamber 15 through the pressurizing passage 31 and increases the pressure of the crank chamber 15. The increase of the crank chamber pressure increases the difference between the pressure applied to the pistons 22 by the crank chamber 15 and the pressure applied to the pistons 22 by the cylinder bores 12*a*. Consequently, the inclination of the swash plate 20 becomes minimal, as shown by the broken lines in FIG. 1, thus shortening the stroke of the pistons 22 and minimizing the displacement of the compressor.

When the solenoid 32*a* is excited, the valve body 32*b* closes the pressurizing passage 31 and disconnects the discharge chamber 25 from the crank chamber 15. This causes the pressure of the crank chamber 15, due to the release of gas into the suction chamber 24 through the bleeding passage 30, to decrease. The decrease of the crank chamber pressure decreases the difference between the pressure applied to the pistons 22 by the crank chamber 15 and the pressure applied to the pistons 22 by the cylinder bores 12*a*. Consequently, the inclination of the swash plate 20 becomes maximal, as shown by the solid lines in FIG. 1, thus lengthening the stroke of the pistons 22 and maximizing the displacement of the compressor.

The hinge mechanism 21 arranged between the lug plate 19 and the swash plate 20 will now be discussed in detail. With reference to FIGS. 1 to 3, two brackets 33, which are spaced equally apart from the drive shaft 16, project from the front surface 20*a* of the swash plate 20. The point corresponding to the top dead center position on the swash plate 20 is located between the brackets 33. Each bracket 33 has a retaining bore 33*a* into which a proximal portion 34*b* of a pin 34 is press-fitted. A spherical portion 34*a* is formed at the distal end of each pin 34.

Two supports 35 project from the rear surface 19*a* of the lug plate 19 in association with the two pins 34. A guide 36 is defined on the distal end of each support 35. The guide 36 includes a bearing surface 36*a*, which has a generally semi-spherical cross-section, and a channel 36*b*, which receives the spherical portion 34*a* of the associated pin 34.

The axis AXg of the guide 36 is parallel to a plane including the axis AXd of the drive shaft 16 and the point on the swash plate 20 corresponding to the upper dead center position. Further, the axis AXg of the guide 36 is inclined so that the axis AXg is farther from the rear surface 19*a* of the lug plate 19 at locations closer to the drive shaft 16. Each pin 34 engages the associated bearing surface 36*a*, and the axis AXp of each pin 34 is substantially perpendicular to the axis AXg of the associated guide 36. Each pin 34 engages the corresponding bearing surface 36*a* so that the spherical portion 34*a* slides in the direction of the axis When the swash plate 20 is arranged at the maximum inclination position, as shown by the solid line in FIG. 1, which maximizes the compressor displacement, the angle θ between the axis AXp of each pin 34 and the axis AXg of the associated guide 36 is close to a right angle. Further, the axis AXp of the pin 34 is substantially parallel to the axis AXd of the drive shaft 16.

Two supports 35 project from the rear surface 19*a* of the lug plate 19 in association with the two pins 34. A guide 36 is defined on the distal end of each support 35. The guide 36 includes a bearing surface 36*a,* which has a generally semi-cylindrical cross-section, and a channel 36*b,* which receives the spherical portion 34*a* of the associated pin 34.

Accordingly, the structure that fixes the proximal portion 34*b* of each pin 34 to the swash plate 20 is simplified. Further, the dimensions of the proximal portions 34*b* of the pins 34 and the retaining bores 33*a* of the brackets 33 do not have to be accurate. The formation of a bulky support on the front surface 20*a* of the swash plate 20 is also not necessary. In addition, the press-fitted portions, which include the proximal portions 34*b* of the pins 34, can be smaller. This allows the pins 34 and their surrounding parts to have smaller dimensions. As a result, the structure for fixing the pins 34 is inexpensive. Further, the weight of the swash plate 20 and the whole compressor are decreased.

In addition, since the guides 36 are located on the lug plate 19, the formation of a large support on the front surface 20*a* of the swash plate 20, as in the compressor of Japanese Unexamined Patent Publication No. 10-54353, is unnecessary. In this manner, an imbalance in the weight of the swash plate 20 is avoided. Therefore, the swash plate 20 is inclined accurately to the desired position when the difference between the pressure of the crank chamber 15 acting on the pistons 22 and the pressure of the cylinder bores 12*a* acting on the pistons 22 changes. Accordingly, the compressor responds quickly to displacement control.

When the inclination of the swash plate 20 and the displacement are maximal, the axis AXp of each pin 34 is substantially parallel to the axis AXd of the drive shaft 16. Accordingly, when the displacement is maximal and the compression load acting on the pins 34 is maximal, the pin axes AXp are substantially parallel to the drive shaft axis AXd. In this state, the compression load acts in a direction coinciding with the axes AXp of the pins 34. This decreases the bending moment M applied to the proximal portions 34*b* of the pin 34 by the large compression loads produced when the compressor is operating in a maximum displacement state.

It should be apparent to those skilled in the art that the present invention may be embodied in many other specific forms without departing from the spirit or scope of the invention. Particularly, it should be understood that the present invention may be embodied in the following forms.

The illustrated embodiment may be modified by providing the lug plate 19 only one of the guides 36 and the swash plate 20 with only one of the pins 34.

Furthermore, the present invention may be applied to a compressor employing a wobble plate in lieu of the swash plate.

The present examples and embodiments are to be considered as illustrative and not restrictive, and the invention is not to be limited to the details given herein, but may be modified within the scope and equivalence of the appended claims.

What is claimed is:

1. A variable displacement compressor having a crank chamber and a cylinder bore within a housing, a drive shaft, having a longitudinal axis, extending through the crank chamber, a lug plate integrally attached to the drive shaft, and a drive plate located adjacent to the lug plate, wherein the drive plate is coupled to the lug plate by a hinge mechanism, wherein the hinge mechanism drives the drive plate and permits the drive plate to rotate with and incline with respect to the drive shaft, and wherein the displacement of the compressor varies according to the inclination of the drive plate based on a pressure difference between the crank chamber and the cylinder bore, wherein the hinge mechanism comprises:

a guide provided on the lug plate, the guide having a bearing surface extending at least partially about a longitudinal guide axis; and a pin projecting from the drive plate along a longitudinal pin axis toward the guide, wherein the pin engages and is guided for sliding movement by the bearing surface of the guide, the longitudinal pin axis and the longitudinal guide axis forming an angle of intersection of not less than about 45°.

2. The compressor as set forth in claim 1, wherein the guide includes a channel facing the drive plate, wherein the channel has an inner bearing surface, and the pin slidably engages the inner bearing surface.

3. The compressor as set forth in claim 2, further comprising a bracket arranged on the drive plate, the bracket including a bore, wherein the pin has a proximal end press-fitted in the bore.

4. The compressor as set forth in claim 3, wherein the axis of the pin is substantially parallel to an axis of the drive shaft when the drive plate is at its maximum inclination.

5. The compressors as set forth in claim 4, further comprising a piston coupled to the drive plate and movable in the cylinder bore by a stroke based on the inclination of the drive plate, the piston having a first end located in the crank chamber and a second end located in the cylinder bore, wherein the inclination of the drive plate is subject to a difference between pressures respectively acting on the first end and the second end.

6. The compressor as set forth in claim 1, wherein the longitudinal guide axis extends nearly perpendicular to the longitudinal axis of the pin within a range of 45° to 90°.

7. The compressor as set forth in claim 1, where in the channel bearing surface is semi-cylindrical in cross-section.

8. The compressor as set forth in claim 1, wherein the axis of the guide extends substantially along the direction of the sliding movement of the pin.

9. A variable displacement compressor having a crank chamber and a cylinder bore within a housing, a drive shaft, having a longitudinal axis, extending through the crank chamber, a lug plate integrally attached to the drive shaft, and a drive plate located adjacent to the lug plate, wherein the drive plate is coupled to the lug plate by a hinge mechanism, wherein the hinge mechanism permits the drive plate to rotate with and incline with respect to drive shaft, and wherein the displacement of the compressor varies according to the inclination of the drive plate based on a pressure difference between the crank chamber and the cylinder bore, wherein the hinge mechanism comprises:

a guide channel opposed to the drive plate, wherein the channel has a longitudinal axis and an inner bearing surface extending at least partially about the longitudinal channel axis; and a pin extending from the drive plate along a longitudinal pin axis toward the guide channel, wherein a distal portion of the pin contacts the bearing surface, the longitudinal pin axis and the longitudinal channel axis forming an angle of intersection of not less than about 45 degrees.

10. The compressor as set forth in claim 9, further comprising a bracket arranged on the drive plate, the bracket including a bore, wherein the pin has a proximal end press-fitted in the bore.

11. The compressor as set forth in claim 10, wherein the longitudinal axis of the pin is substantially parallel to the longitudinal axis of the drive shaft when the drive plate is at its maximum inclination.

12. The compressor as set forth in claim 11, further comprising a piston coupled to the drive plate and movable in the cylinder bore by a stroke based on the inclination of the drive plate, the piston having a first end located in the crank chamber and a second end located in the cylinder bore, wherein the inclination of the drive plate is subject to a difference between pressures respectively acting on the first end and the second end.

13. The compressor as set forth in claim 9, wherein the longitudinal channel axis extends nearly perpendicular to the longitudinal axis of the pin within a range of 45° to 90°.

14. The compressor as set forth in claim 9, wherein the channel bearing surface is semi-cylindrical in cross-section.

15. A variable displacement compressor having a crank chamber and a plurality of cylinder bores within a housing, a drive shaft, having a longitudinal axis, extending through the crank chamber, a lug plate integrally attached to the drive shaft, a drive plate located adjacent to the lug plate, and a plurality of pistons located in the cylinder bores, respectively, each of the pistons being coupled to the drive plate, wherein the drive plate is coupled to the lug plate by a hinge mechanism, wherein the hinge mechanism drives the drive plate and permits the drive plate to incline with the drive shaft, and wherein the displacement of the compressor varies according to the inclination of the drive plate based on a pressure difference in the crank chamber and the cylinder bore, wherein the hinge mechanism comprises:

a pair of guide channels opposed to the drive plate, wherein each channel has a longitudinal axis and an inner bearing surface extending at least partially about the longitudinal channel axis;

a pair of brackets carried by the drive plate, each of said brackets having a bore; and a pair of pins extending from the drive plate toward the guide channels, wherein each of the pins has a distal end that engages the inner bearing surfaces and a proximal end that is press-fitted into the bore, each pin having a longitudinal axis that intersects a respective longitudinal channel axis at an angle of not less than about 45 degrees.

16. The compressor as set forth in claim 15, wherein said drive plate includes a swash plate.

17. The compressor as set forth in claim 15, wherein the longitudinal axis of each pin is substantially parallel to the longitudinal axis of the drive shaft when the drive plate is at its maximum inclination.

18. The compressor as set forth in claim 15, wherein each pin has a spherical portion at its distal end.

19. The compressor as set forth in claim 15, wherein the longitudinal channel axis extends nearly perpendicular to the longitudinal axis of the pin within a range of 45° to 90°.

20. The compressor as set forth in claim 15, wherein the channel bearing surface is semi-cylindrical in cross-section.

* * * * *

UNITED STATES PATENT AND TRADEMARK OFFICE

CERTIFICATE OF CORRECTION

PATENT NO. : 6,474,955 B1 
DATED : November 5, 2002
INVENTOR(S) : Ota et al.

It is certified that error appears in the above-identified patent and that said Letters Patent is hereby corrected as shown below:

Title page,
Item [57], ABSTRACT,
Line 1, please delete "variable displacement" and insert therefore -- A variable displacement --.

Column 5,
Line 4, after "of the axis", insert -- AXg. --.

Column 6,
Line 31, delete "wherein the axis" and insert therefore
-- wherein the longitudinal axis --;
Line 32, delete "parallel to an axis" and insert therefore
-- parallel to the longitudinal axis --;
Line 45, delete "where in the" and insert therefore
-- wherein the --.

Signed and Sealed this

First Day of April, 2003

JAMES E. ROGAN
*Director of the United States Patent and Trademark Office*